US009038577B1

(12) United States Patent
Lankinen

(10) Patent No.: US 9,038,577 B1
(45) Date of Patent: May 26, 2015

(54) EVAPORATOR SURFACE STRUCTURE OF A CIRCULATING FLUIDIZED BED BOILER AND A CIRCULATING FLUIDIZED BED BOILER WITH SUCH AN EVAPORATOR SURFACE STRUCTURE

(75) Inventor: Pentti Lankinen, Varkaus (FI)

(73) Assignee: FOSTER WHEELER ENERGIA OY, Espoo (FI)

( * ) Notice: Subject to any disclaimer, the term of this patent is extended or adjusted under 35 U.S.C. 154(b) by 1520 days.

(21) Appl. No.: 12/300,837

(22) PCT Filed: May 18, 2007

(86) PCT No.: PCT/FI2007/050284
§ 371 (c)(1),
(2), (4) Date: Aug. 13, 2009

(87) PCT Pub. No.: WO2007/135239
PCT Pub. Date: Nov. 29, 2007

(30) Foreign Application Priority Data

May 18, 2006 (FI) ..... 20060488

(51) Int. Cl.
*F22B 21/20* (2006.01)
*F22B 29/06* (2006.01)

(52) U.S. Cl.
CPC ..... *F22B 29/062* (2013.01)

(58) Field of Classification Search
USPC ..... 122/450
See application file for complete search history.

(56) References Cited

U.S. PATENT DOCUMENTS

| | | | | |
|---|---|---|---|---|
| 3,736,908 | A | 6/1973 | Ehrlich et al. | 122/4 D |
| 3,834,358 | A * | 9/1974 | Frendberg et al. | 122/510 |
| 5,215,042 | A | 6/1993 | Beisswenger et al. | 122/4 D |
| 5,299,532 | A * | 4/1994 | Dietz | 122/4 D |
| 5,471,955 | A * | 12/1995 | Dietz | 122/4 D |
| 5,678,497 | A | 10/1997 | Goidich | 110/245 |
| 6,470,833 | B1 | 10/2002 | Hyppänen | 122/4 D |

FOREIGN PATENT DOCUMENTS

| | | |
|---|---|---|
| CN | 1376249 A | 10/2002 |
| DE | 202 20 794 U1 | 5/2004 |

(Continued)

OTHER PUBLICATIONS

Decision on Grant issued Dec. 25, 2009, in corresponding Russian patent application No. 2008149929, with English translation.
Chinese Office Action dated Apr. 19, 2010, issued in counterpart Chinese patent application No. 200780018048.3, with an English translation.

(Continued)

*Primary Examiner* — Alissa Tompkins
*Assistant Examiner* — John Bargero
(74) *Attorney, Agent, or Firm* — Fitzpatrick, Cella, Harper & Scinto

(57) ABSTRACT

An evaporator surface structure of a circulating fluidized bed boiler having a furnace that is enclosed by sidewalls and has a bottom and a ceiling. The evaporator surface structure includes at least one vertical and separate evaporator surface unit that is spaced apart from the sidewalls of the furnace. The at least one evaporator surface unit (i) is formed of planar water tube panels that extend from the bottom of the furnace to the ceiling of the furnace, and (ii) consists of two cross-wise joined vertical water tube panels.

21 Claims, 3 Drawing Sheets

(56) References Cited

FOREIGN PATENT DOCUMENTS

| | | | |
|---|---|---|---|
| DE | 103 54 136 | A1 | 6/2004 |
| EP | 0 179 996 | A1 | 5/1986 |
| GB | 1311869 | | 3/1973 |
| GB | 2 098 707 | A | 11/1982 |
| GB | 2 126 323 | A | 3/1984 |
| JP | 6-137504 | | 5/1994 |
| JP | 6-137506 | | 5/1994 |
| JP | 2002-530621 | A | 9/2002 |
| RU | 1817516 | C | 7/1995 |
| RU | 2078285 | C1 | 4/1997 |
| SU | 245262 | | 9/1969 |
| SU | 1078194 | A2 | 3/1984 |
| SU | 1430674 | A1 | 10/1988 |
| WO | WO 00/31468 | | 6/2000 |
| WO | 01/65175 | A1 | 9/2001 |

OTHER PUBLICATIONS

Finnish Official Action dated Jan. 17, 2007, issued in counterpart Finnish patent application No. 20060488.

English translation of Japanese Official Action dated Jul. 26, 2011, issued in counterpart Japanese patent application No. 2009-510484.

International Search Report dated Dec. 13, 2007, which was mailed in a Communication dated Dec. 21, 2007, and which issued in corresponding International Application No. PCT/FI2007/050284.

Written Opinion of the International Searching Authority mailed Dec. 21, 2007, issued in International Application No. PCT/FI2007/050284.

First Examination Report issued by the Government of India Patent Office on Oct. 7, 2013, in corresponding Indian Patent Application No. 6252/CHENP/2008.

* cited by examiner

EVAPORATOR SURFACE STRUCTURE OF A CIRCULATING FLUIDIZED BED BOILER AND A CIRCULATING FLUIDIZED BED BOILER WITH SUCH AN EVAPORATOR SURFACE STRUCTURE

This application is a U.S. national stage application of PCT International Application No. PCT/FI2007/050284, filed May 18, 2007, and published as PCT Publication No. WO 2007/135239 A2, and which claims priority from Finnish patent application number 20060488, filed May 18, 2006.

FIELD OF THE INVENTION

The present invention relates to an evaporator surface structure of a circulating fluidized bed boiler (CFB boiler) and a circulating fluidized bed boiler with such an evaporator surface structure. The invention especially relates to an evaporator surface structure arranged in a furnace of a large CFB boiler, typically, a once-through utility boiler of over 400 $MW_e$.

BACKGROUND OF THE INVENTION

In CFB boilers, the evaporation of heated feed water, i.e., boiling takes place mostly by means of water tube panels in the outer walls of the boiler furnace. When increasing the efficiency of the boiler, the cross-sectional area of the furnace must be increased proportionally with the efficiency, to be able to combust the required amount of fuel with a flow speed of oxygenous fluidizing gas corresponding to the original flow speed. Since it is not advantageous to form the shape of the horizontal cross section of the boiler to be very oblong, nor to increase the height of the boiler too much, the total area of the evaporator surfaces formed by the outer walls of the furnace tends to remain too small in large boilers. For example, if oxygen-enriched air is used instead of air as fluidizing gas, the surface area of the furnace walls available for evaporator surfaces may decrease even more. The additional need for evaporator surface area may also increase when using low-ash fuel with a good heat value, for example, dry coal.

To ensure a sufficient evaporator surface area in large boilers, it has been suggested to have different parts of additional evaporator surfaces disposed in the furnace. U.S. Pat. Nos. 3,736,908 and 5,215,042 disclose the division of the furnace by longitudinal, transverse or cross-wise water tube walls extending from wall to wall, the lower part of which has an opening or openings enabling the flow of material. U.S. Pat. No. 5,678,497 suggests the increase of heat exchange surfaces in the furnace by dividing the furnace into two by a longitudinal partition having short transverse wall portions connected thereto. Despite the openings in the partitions, both of the above-mentioned embodiments have a risk of not having the flows of the solid material and the gas in balance between the different parts of the divided furnace, which may, for example, increase environmental emissions or even cause an oscillating operation in the whole boiler. U.S. Pat. No. 6,470,833 discloses an arrangement, in which the operation of the furnace of the CFB boiler is improved by forming additional evaporator surfaces to separate, closed evaporator cavities extending from the bottom to the ceiling of the furnace. The disadvantage with these evaporator cavities is that they decrease the bottom surface area available, and increase heat exchange surface area only relatively little.

SUMMARY OF THE INVENTION

The purpose of the present invention is to provide an evaporator surface structure for a circulating fluidized bed boiler, which reduces problems related to the prior art evaporator surface structures for a circulating fluidized bed boiler.

The purpose of the invention is, especially, to provide a simple and durable evaporator surface for a circulating fluidized bed boiler, enabling sufficient evaporation efficiency without disturbing the combustion process of the boiler.

It is also a purpose of the invention to provide a circulating fluidized bed boiler with such an evaporator surface structure.

In order to solve the above-mentioned prior art problems, it is suggested to provide an evaporator surface structure for a circulating fluidized bed boiler and a circulating fluidized bed boiler with an evaporator surface structure with characterizing features as defined in the independent claims.

Thus, it is a characterizing feature of the evaporator surface structure for a circulating fluidized bed boiler in accordance with the present invention that it comprises at least one separate vertical evaporator structure unit within a distance from the walls of the furnace, formed of water tube panels, extending from the furnace bottom of the circulating fluidized bed boiler to the ceiling, the evaporator surface consisting of two cross-wise joined vertical water tube panels.

The water tube panels of the evaporator surface units in accordance with the invention are preferably conventional water tube panels, formed by joining a group of water tubes by means of fins, i.e., by narrow metal plates, so that they form at least a partially gas-tight planar panel. The height of the water tube panels in the evaporator surface units thus corresponds to the height of the furnace, and their width is preferably 1-5 m, most preferably, 2-3 m. When two such panels are joined cross-wise, a durable and rigid structure is provided. The evaporator surface structure formed by evaporator surface units in accordance with the invention is reliable in use, even when assembled in a furnace of a large CFB boiler, the height of which can be 40-50 m, even though the width of the water tube panels, were, for example, only 2-3 m.

Since no empty space is left inside the evaporator surface units, as in the arrangement of U.S. Pat. No. 6,470,833, the evaporator surface structure in accordance with the invention does not substantially decrease the cross-sectional area available for the combustion process in the furnace, and thus, does not cause any need to increase the outer dimensions of the furnace. The evaporator surface units are separate and spaced apart from the outer walls, and, therefore, the gases and solids in the furnace are allowed to move as freely as possible in all parts of the furnace. Thus, the different parts of the furnace are in balance with each other and the operation of the boiler can easily be adjusted so that the environmental emissions are minimized.

In some cases, it is possible to arrange only one evaporator surface unit in accordance with the invention to a small CFB boiler, but large boilers preferably have two or more evaporator surface units. According to a preferred embodiment, a boiler comprises three longitudinally subsequent evaporator surface units. Especially, in very large boilers, there can be four or even more evaporator surface units and they can also be arranged to the furnace other than longitudinally, subsequently, for example, they can be arranged in two rows.

The water tube panels of the evaporator surface units are preferably at a right angle with each other. By using this arrangement, the formation of too tight of corners for the movement of solid material, so-called dead corners, is avoided. In some cases, the smallest angle between the panels may, however, to some extent, differ from the right angle.

The water tube panels of the evaporator units are preferably symmetrically cross-wise, whereby additional heat exchange surface is obtained evenly in every direction. Especially, the water tube panels of the evaporator surface units closest to the side walls of the furnace may, however, be joined cross-wise in a T-form in such a way that the panel portion on the side wall is missing. Thereby, the flow of the solid material in close proximity to the side wall is as free as possible. In some cases, it may also be advantageous to join the water tube panels of the evaporator surface units to each other in the shape of an L, which is considered here to be a special case of cross-wise combining, the panel portions of two directions being missing. According to one preferred embodiment, one or two symmetrically cross-wise joined evaporator units are formed in the middle of the furnace, and an evaporator surface unit is formed cross-wise in a T-form in close proximity to each sidewall.

The evaporator surface units are preferably arranged to the furnace in such a way that a first water tube panel of each evaporator surface unit is parallel with the water tubes of the furnace ceiling, i.e., in a longitudinal direction of the cross section of the furnace. Thereby, a second water tube panel is preferably perpendicular to the first panel, i.e., in a transverse direction of the furnace. In some cases, it also may be advantageous to arrange water tube panels of the evaporator surface units in an inclined position relative to the walls of the boiler.

When the perpendicularly connected water tube panels of the evaporator surface units are arranged parallel with the furnace walls, the water tubes of the water tube panels can be arranged in a simple way to run between the water tubes of the water tube panel in the furnace ceiling. Naturally, if the diameters of the tubes of the water tube panels in the evaporator surface units are larger than the distances between the tubes of the water tube panel in the ceiling, i.e., the widths of the fins between the tubes, the water tubes of the ceiling are bent in a suitable way so that the tubes in the water tube panels have enough space to run between the water tubes in the ceiling. A preferred method of bending the tubes in the water tube panels of the evaporator surface units in the upper part of the furnace is discussed later in more detail.

The symmetrically cross-wise set of water tube panels can preferably be approximately the same width. According to a preferred embodiment, the width of the transverse panels in the furnace is, however, about 1.5 to 2 times the width of the longitudinal panels. A sufficient evaporator surface area is thus gained, although the panels are arranged in such a way that the flames of the startup burners in the front and rear walls do not reach them. Preferably, an opening is or openings are formed in the panels, especially, to the lower part of the broader panels in the evaporator surface units, so as to allow free movement of the solid material in the furnace. The most preferred widths and ratios of widths of the panels depend, for example, on the number of the evaporator units and on the dimensions of the boiler furnace. The ratio of the widths of the first and second water tube panels is preferably between 1:3-3:1.

According to a preferred embodiment of the present invention, the water tubes of the water tube panels in each evaporator surface unit are connected from the upper part to separate outlet headers arranged at different heights parallel with the water tube panels. When the water tubes of the evaporator unit are joined in this way, instead of one outlet header to two separate outlet headers, the connecting of the water tubes to the outlet headers is made easier, and the connecting tubes of the water tubes outside the furnace can be maintained to be short, and their bendings relatively simple.

Steam is led from the outlet headers, the lengths of which are preferably approximately the same as the widths of the corresponding water tube panels, preferably, by means of connecting ducts to a separator for water and vapor. Especially, when the boiler is a once-through utility boiler, the outlet headers of each evaporator surface unit are preferably joined to each other by means of a steam pressure balancing tube. Further, the outlet headers of the evaporator surface units are also preferably joined by steam pressure balancing tubes to the outlet headers of the water tube panels in the sidewalls of the furnace.

The water tube panels of the evaporator surface units according to the invention are preferably suspended to hang from the outlet headers of the water tube panels. Therefore, a sufficient portion, preferably, at least a fourth, most preferably, at least a third of the water tubes of the water panels is joined vertically, without bendings, to the lower edge of the outlet headers. The outlet headers are preferably suspended to hang from the stationary supporting structure of the boiler.

Since the water tube panels of the evaporator surface units located in the furnace according to the invention are heated in the furnace from both sides, the panels must be designed, especially in once-through utility boilers, in such a way that the flow of the heated feed water is distributed in a desired way between them and the evaporator surfaces of only one side of the heated outer walls of the furnace. According to a preferred embodiment, the water tubes of the evaporator surfaces in the outer walls of a once-through utility boiler are conventional, smooth water tubes, and the water tubes of the evaporator surfaces in the furnace are so-called rifled tubes, to ensure efficient heat exchange and cooling of the evaporator surfaces.

Correspondingly, the diameters of the water tubes in the evaporator surfaces inside the furnace and the distance between the tubes may be different from the diameters and the distance between the water tubes in the outer walls of the boiler. Especially, when the distance between the tubes in the water tube panels of the evaporator surface units is greater than the distance between the water tubes of the furnace ceiling, the water tubes of the water tube panels in the evaporator surfaces perpendicular to the direction of the water tubes of the ceiling must be bent in such a way that, at least in some locations, at least two water tubes of the water tube panels of the evaporator surfaces run through the same opening between the water tubes of the ceiling.

According to a preferred arrangement, the ratio between the distance of the central points of the water tubes in the water tube panels of the evaporator surface units and the distance between the central points of the water tubes of the ceiling of the furnace is approximately 2:3. Thereby, advantageously, every second water tube of the furnace ceiling is bent towards the adjacent tube at the points where the water tubes in the water tube panels perpendicular to the tubes of the furnace ceiling are led through the ceiling, so as to provide a sufficient opening in every other space between the water tubes of the ceiling for bringing the water tubes in the water tube panels of the evaporation surface unit through the ceiling. Bringing the water tubes of the water tube panels in the evaporator surface units through the ceiling can then be arranged, preferably, in such a way that every third water tube runs unbent through an opening formed between the water tubes of the ceiling, and the next two tubes are bent to run in-line through the same opening.

A regular arrangement, in which some of the water tubes run unbent through the ceiling, also can be provided when the ratio of the distance between the center points of the water tubes in the water tube panels of the evaporator surface units to the distance between the center points of the water tubes in the furnace ceiling is N:M, where N and M are unequal small integers, preferably, less than five. If, for example, N is three and M is four, four tubes of the panel in the evaporator surface unit can be brought to run regularly through every third space between the water tubes in the ceiling, whereby, every fourth tube of the panel in the evaporator surface unit can run virtually.

The above-described differences between the evaporator surfaces in accordance with the invention and the evaporator surfaces in the outer walls of the furnace result in that the temperature distribution in the evaporator surfaces inside the furnace do not necessarily correspond in all situations to the temperature distribution in the water tube panels in the outer walls of the boiler. These differences thus possibly cause some deviation in the thermal expansion of the water tube panels in accordance with the invention as compared to the thermal expansion of the rest of the boiler. Generally, large CFB boilers are suspended from above, whereby, the lower part of the boiler and all equipment to be connected thereto are designed in such a way that, when the boiler temperature is raised to the operational temperature and the length of the boiler walls increases because of thermal expansion, the lower part of the boiler can move downwards, even as much as tens of centimeters.

Since the temperature of the evaporator surface structures located in the furnace may be, for example, during the start up of the boiler, higher than the temperature of the outer walls of the boiler, the evaporator surface structures are preferably arranged so that they can move relative to the outer walls of the furnace. According to a preferred embodiment of the present invention, this is carried out in such a way that the lower parts of the evaporator surface units in the evaporator surface structure are stationarily mounted to the boiler bottom, but the upper parts of the evaporator surface units may move relative to the ceiling. Therefore, the evaporator surface structure is arranged spaced apart from the sidewalls of the boiler, and the outlet headers supporting the structure are preferably suspended to hang by means of flexible elements. The strain of the flexible element, for example, a spring, of the suspension, is preferably adjustable in order to eliminate possible vibration in the evaporator surface unit.

In such an arrangement, it is not possible to attach the evaporator surface structure stationarily to the ceiling of the boiler, but the joint comprises a vertically flexible structure, preferably, a bellows. Such a structure enables the connection of the evaporator surface structure gas-tight to the ceiling, but the structure may, to some extent, move vertically relative to the ceiling.

BRIEF DESCRIPTION OF THE DRAWINGS

The invention is described in more detail below, with reference to the accompanying drawings, in which.

DETAILED DESCRIPTION OF THE PREFERRED EMBODIMENTS

Figure 1:
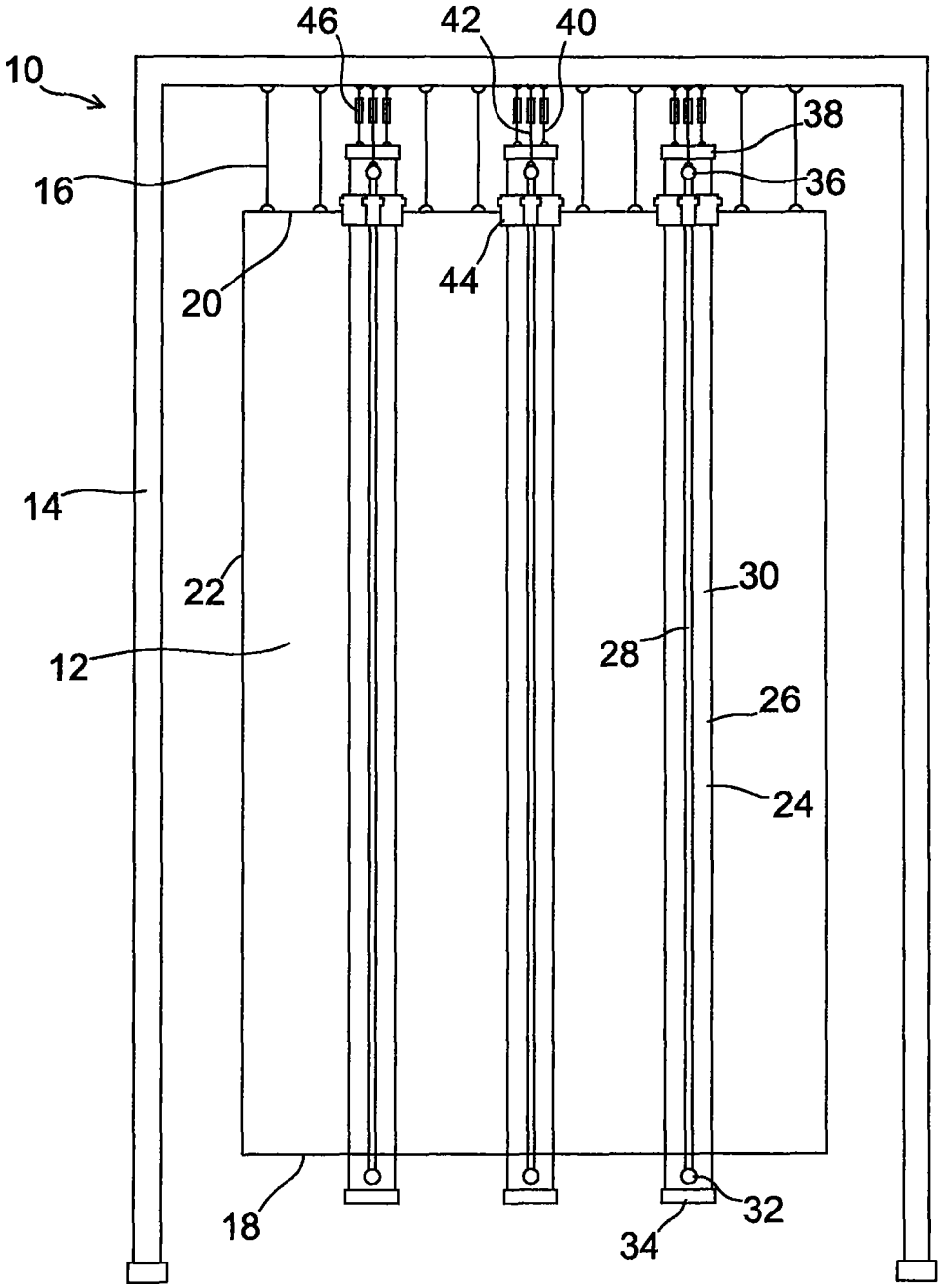
FIG. 1 schematically illustrates a vertical cross-sectional view of a circulating fluidized bed boiler having an evaporator surface structure in accordance with a preferred embodiment of the present invention.

FIG. 1 illustrates a CFB boiler 10, in accordance with a preferred embodiment of the present invention, comprising a furnace 12 suspended to hang from a stationary supporting structure 14 by means of suspending means 16, for example, by hanger rods. The boiler in accordance with the invention may be a natural circulation boiler, in other words, a drum boiler, but, most preferably, it is a supercritical once-through utility boiler. The furnace is limited by a bottom 18, a ceiling 20 and sidewalls 22, which are usually of a water tube structure. The furnace is also provided with other conventional parts of a CFB boiler, such as inlet means for fuel and combustion air, outlet means for flue gas and bottom ash, as well as dust separators and return ducts connected thereto. For simplicity, these details, which are irrelevant in view of the present invention, are not shown in FIG. 1.

The outer walls 22 of the furnace are normally manufactured of water tube panels, in which the feed water, which is preheated in the heat exchange section of the flue gas channel, is evaporated, i.e., turned to vapor. According to the present invention, the CFB boiler illustrated in FIG. 1 also contains an evaporator surface structure 24 arranged inside the furnace 12, the evaporator surface structure comprising three vertical evaporator surface units 26 extending from the bottom 18 of the furnace to the ceiling 20. The evaporator surface units 26 consist of two water tube panels 28, 30 connected to each other perpendicularly in a cross-wise configuration.

The preheater feed water and the possible liquid being returned from the steam separator are brought to inlet headers 32, 34 connected to the lower part of the water tube panels 28, 30 of the evaporator surface units, from where it is led to the panels 28, 30 to be evaporated, and further, as vapor to the outlet headers 36, 38. If the boiler is a so-called drum boiler, the driving force in getting the water and steam upwards is the weight of the liquid column in the drop leg of the drum. However, if the boiler is a so-called forced circulation boiler, especially, a so-called supercritical once-through utility boiler, the driving force is pressure generated by the pump of the water cycle. The inlet headers 32, 34 and outlet headers 36, 38 are preferably arranged cross-wise parallel to the panels, at different levels relative to each other. The steam generated in the evaporator surface units 26, possibly still containing some liquid water, is led from the outlet headers 36, 38 to a steam separator (not shown in FIG. 1). The separated steam is led from the steam separator further to superheaters arranged, for example, in the flue gas channel.

The water tube panels 28, 30 are preferably suspended to hang from the supporting structure 14 by means of supporting means, e.g., hanger rods 40, 42, connected to the outlet headers 36, 38. The water tube panels 28, 30 are preferably assembled stationarily through the bottom 18 of the furnace in such a way that the panels cannot move relative to the bottom. Since the water tube panels 28, 30 arranged inside the furnace can, in some cases, be at a temperature different from that of the water tube panels of the sidewalls 22, the heat expansions of these different panels may differ from each other. Therefore, the water tube panels 28, 30 are preferably joined to the furnace ceiling by means of cross-shaped bellows 44 enabling the vertical movement. In order to keep the support of the panels functional in all conditions, the hanger rods 40, 42 also comprise a spring-like element 46. The strain of the flexible element of the support is preferably adjustable so as to be able to eliminate vibration of the evaporator surface unit, for example, transverse or rotary vibration.

Figure 2:
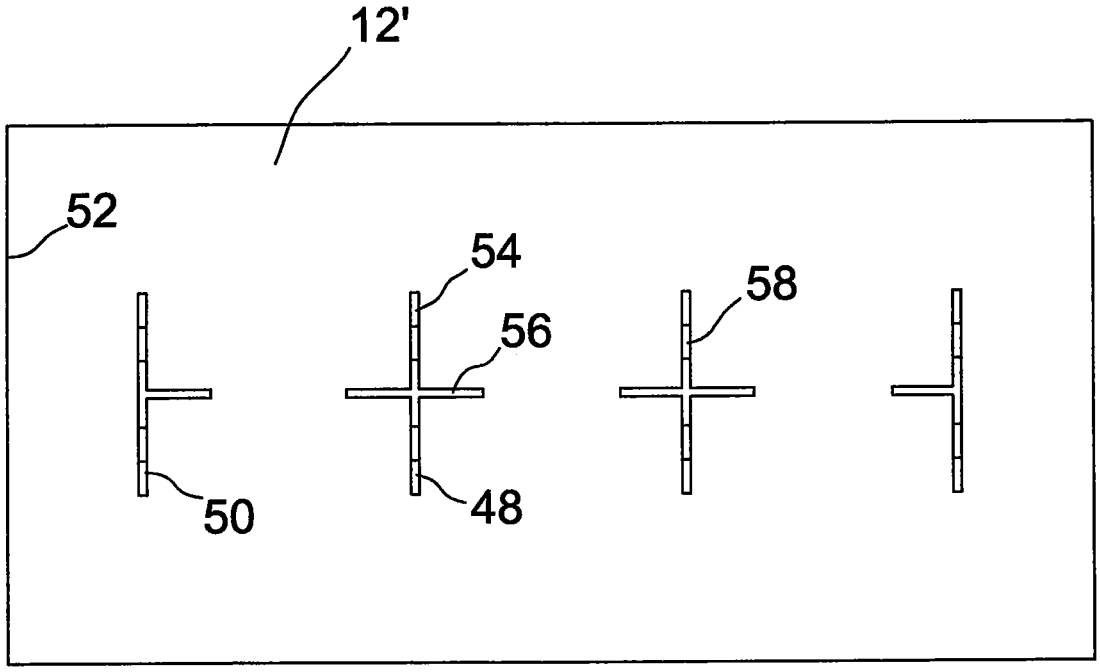
FIG. 2 schematically illustrates a horizontal cross-sectional view of a circulating fluidized bed boiler having an evaporator surface structure in accordance with another preferred embodiment of the present invention.

In an embodiment in accordance with FIG. 1, all evaporator surface units 26 are identical, extending in every direction, in the shape of a cross. FIG. 2 schematically illustrates a horizontal cross section of another preferred embodiment showing that the most central unit 48 of the four evaporator surface units set to the furnace 12' are of the shape of a symmetrical cross, extending in every direction, but the units 50, closest to the end walls 52 of the furnace, are of a T-shape, in such a way that the panel part of the end wall side is missing from the evaporator surface unit.

The water tube panels 54, 56 of the evaporator surface units in accordance with the invention are preferably stationarily assembled to each other in a right angle, forming a durable construction, which provides a lot of additional heat exchange surface to the furnace 12. The angle between the panels may also deviate to some extent from the right angle, especially, if there are two panel parts missing from the cross-structure formed by the panels and the cross section of the panels is of an L-shape. The evaporator surface units 48, 50 are preferably arranged in a line to the greatest dimension of the furnace 12, but, in some cases, the units may also be located otherwise, for example, in two lines.

The widths of the evaporator surface units 54, 56 are preferably approximately equal. It may, however, often be advantageous to use panel widths that are, to a certain extent, different, for example, in such a way that the panels 54 that are transverse relative to the furnace are 1.5 to 2 times wider than the corresponding longitudinal panels 56. Thereby, the material flows coming from the front and rear walls of the furnace, in other words, from the long outer walls thereof, or, for example, the flames of the start up burners, may be arranged in such a way that they do not directly hit the longitudinal water tube panels 56.

Especially, when the width of the panel parts in the evaporator surface units is a significant portion of the corresponding dimension of the furnace, an opening 58 is or openings are formed in the panels, especially, to the lower parts thereof, to enable as free a flow of the solid material in the furnace as possible.

Figure 3:
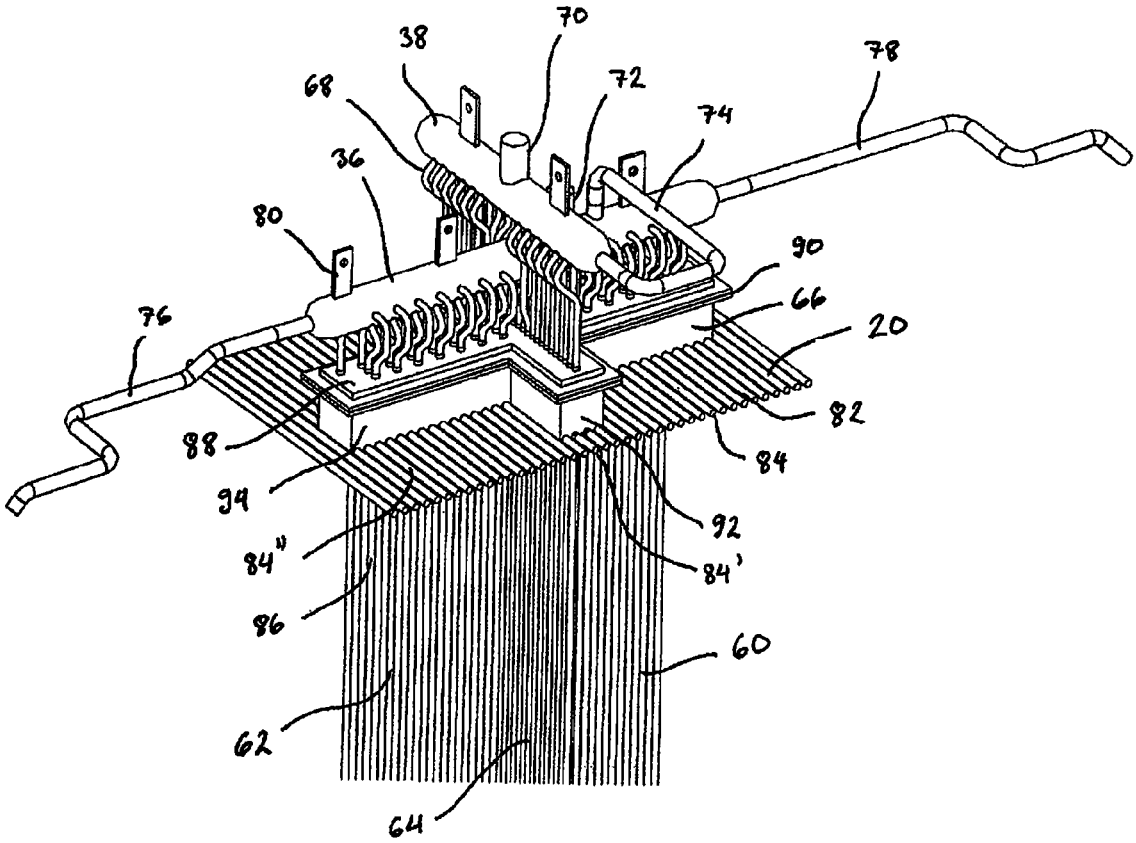
FIG. 3 schematically illustrates an upper part of the evaporator surface unit in accordance with a preferred embodiment of the present invention.

FIG. 3 illustrates in more detail the inlets of the water tube panels 62, 64 in an evaporator surface unit 60 of the shape of a symmetric cross through the furnace ceiling 20 by means of a bellows box 66, and the connecting of water tubes of the panels 62, 64 to the water cycle boiler. The vapor formed in an evaporator surface unit 60 is preferably gathered to two outlet headers 36, 38 parallel to the water tube panels 62, 64. Thereby, the extensions of the water tubes required for connecting the water tubes of the water tube panels 62, 64 to different sides of the outlet headers 36, 38, and, especially, the tube bends 68 thereof, can be formed in a simple manner in a compact space.

The vapor gathered in outlet headers 36, 38 is guided to the steam separator by means of connecting tubes 70, 72 connected to outlet headers 36, 38. For balancing the vapor pressure, the inlet headers 36, 38 are preferably connected together by a balancing tube 74. Correspondingly, the outlet headers 36, 38 are preferably connected to outlet headers of the sidewalls (not in FIG. 3) by means of balancing tubes 76, 78. FIG. 3 also shows the attaching means 80 of the hanger rods of the evaporator surface unit 60 connected to the outlet headers 36, 38.

If the distances of the center points of the water tubes in the water tube panels 62, 64 of the evaporator surface unit 60 are the same as the distances of the center points of the water tubes 84 in the water tube panel 82 of the furnace ceiling, and the diameters of the water tubes of the panels 62, 64 are smaller than widths of the fins in the water tube panel 82 of the ceiling 20 of the furnace, it is possible simply to lead the water tubes 62, 64 directly through the furnace ceiling 20 through openings formed in the fins of the water tube panel 82. If the width of the fins is not sufficient, the water tubes 84 of the furnace ceiling 20 must be bent to form these openings through the ceiling. If, in turn, the water tubes in the water tube panels 62, 64 are situated closer to each other than the water tubes in the water tube panel 82, at least a portion of the water tubes 86 of the water tube panel 62 perpendicular to the water tubes 84 in the furnace ceiling 20 must be bent for leading the tubes through the ceiling.

According to a preferred embodiment of the present invention, a lower part of the cross-shaped bellows box 66 is stationarily connected to the water tube panel 82 of the furnace ceiling 20, and, correspondingly, a cover 88 of the bellows box is stationarily connected to the water tubes in the water tube panels of the evaporator surface unit 60. There is a flexible element 90, preferably, a metal bellows, between the lower part of the bellows box 66 and the cover 88 thereof, for enabling the vertical motion of the water tubes in the water tube panels 62, 64 relative to the furnace ceiling 20. The bellows box 66 and the furnace ceiling 20 together form a gas-tight construction preventing the escape of the combustion gases and furnace particles through the furnace ceiling.

Water tubes 84' in the furnace ceiling 20 inside a branch 92 of the bellows box 66 parallel to the water tubes 84 of the furnace ceiling 20 are bent, when required, in such a way that a sufficient opening (not shown in FIG. 3) is formed to lead the water tubes of the corresponding panel portion 64 of the evaporator surface unit 60 through the ceiling. Correspondingly, water tubes 84" inside a branch 94 of the bellows box 66 perpendicular to the water tubes 84 of the furnace ceiling 20 are bent, if necessary, in such a way that openings (not shown in FIG. 3) are formed to lead water tubes of the corresponding panel portion 62 of the evaporator surface unit through the ceiling.

According to a preferred embodiment of the invention, the ratio of the distance of the central points of the water tubes in the water tube panels 62, 64 of the evaporator surface unit 60 and the distance of the central points of water tubes 70 of water tube panel 82 of the ceiling 20 is 2:3. Thereby, it is possible to advantageously bend three water tubes of the panel 62 to form a line parallel to the water tubes 84 of the furnace ceiling 20, which line is led through the ceiling 20 through the same opening formed between the water tubes 84". FIG. 3 does not show the bending of the water tubes in the panel 62 to a line, but the upper parts of the lines thus formed are to be seen above the branch 94 of the box 66.

The invention has been described above with reference to some exemplary embodiments. These embodiments are, however, not given to limit the scope of invention, but the invention is limited merely by the accompanying claims and the definitions therein.

The invention claimed is:

1. An evaporator surface structure of a circulating fluidized bed boiler, the evaporator surface structure comprising:

a furnace that is enclosed by sidewalls and has a bottom and a ceiling; and at least one vertical evaporator surface unit that is separate from and spaced apart from the sidewalls of the furnace, the at least one evaporator surface unit (i) being formed of planar water tube panels, formed by joining a group of water tubes by means of fins, that extend from the bottom of the furnace to the ceiling of the furnace, and (ii) consisting of two water tube panels that are connected to each other in a cross-wise configuration, wherein the water tube panels in each evaporator surface unit are suspended to hang from separate outlet headers arranged at different heights parallel with the water tube panels.

2. An evaporator surface structure in accordance with claim 1, wherein the evaporator surface structure comprises at least two evaporator surface units.

3. An evaporator surface structure in accordance with claim 1, wherein the planar water tube panels of the at least one evaporator surface unit are perpendicular to each other.

4. An evaporator surface structure in accordance with claim 3, wherein the water tube panels of the at least one evaporator surface unit are symmetrically cross-wise.

5. An evaporator surface structure in accordance with claim 3, wherein the water tube panels of the at least one evaporator surface unit are connected cross-wise in a T shape.

6. An evaporator surface structure in accordance with claim 3, wherein a first water tube panel of each evaporator surface unit is parallel to water tubes of the furnace ceiling and a second water tube panel is perpendicular to the first water tube panel.

7. An evaporator surface structure in accordance with claim 6, wherein the ratio of the widths of the first and the second water tube panels is from 1:3 to 3:1.

8. An evaporator surface structure in accordance with claim 6, wherein the water tubes of the first and second water tube panels are joined from their upper part to headers of the evaporator surface units, the headers being parallel to the respective first and second water tube panels.

9. An evaporator surface structure in accordance with claim 8, wherein the boiler is a once-through utility boiler and the headers of each evaporator surface unit are joined to each other by a steam pressure balancing tube.

10. An evaporator surface structure in accordance with claim 8, wherein the boiler is a once-through utility boiler and the headers of the evaporator surface units are joined by a steam pressure balancing tube to headers of water tube panels in the sidewalls of the furnace.

11. An evaporator surface structure in accordance with claim 8, wherein the water tube panels are suspended to hang from the headers.

12. Au evaporator surface structure in accordance with claim 11, wherein the headers are flexibly suspended by a flexible element to hang from a stationary supporting structure of the boiler.

13. An evaporator surface structure in accordance with claim 12, wherein strain of the flexible element is adjustable in order to eliminate vibration of the at least one evaporator surface unit.

14. An evaporator surface structure in accordance with claim 12, wherein each evaporator surface unit is joined to the ceiling of the furnace by a flexible structure that enables vertical movement between the at least one evaporator surface unit and the ceiling.

15. An evaporator surface structure in accordance with claim 14, wherein the flexible structure comprises a bellows.

16. An evaporator surface structure in accordance with claim 11, wherein at least a portion of the water tubes in the second water tube panel is arranged to form lines parallel to the water tubes of the furnace ceiling at the level of the ceiling.

17. A circulating fluidizing bed boiler comprising:

(a) a furnace that is enclosed by sidewalls and has a bottom and a ceiling; and (b) an evaporator surface structure comprising:

at least one vertical evaporator surface unit that is separate from and spaced apart from the sidewalls of the furnace, the evaporator surface unit (i) being formed of planar water tube panels, formed by joining a group of water tubes by means of fins, that extend from the bottom of the furnace to the ceiling of the furnace, and (ii) consisting of two vertical water tube panels that are connected to each other in a cross-wise configuration, wherein the water tube panels in each evaporator surface unit are suspended to hang from separate outlet headers arranged at different heights parallel with the water tube panels.

18. An evaporator surface structure in accordance with claim 17, wherein the evaporator surface structure comprises at least two evaporator surface units.

19. An evaporator surface structure in accordance with claim 17, wherein the planar water tube panels of the at least one evaporator surface unit are perpendicular to each other.

20. An evaporator surface structure in accordance with claim 17, wherein the water tube panels of the at least one evaporator surface unit are symmetrically cross-wise.

21. An evaporator surface structure in accordance with claim 17, wherein the water tube panels of the at least one evaporator surface unit are connected cross-wise in a T shape.

* * * * *